United States Patent [19]

Houck et al.

[11] Patent Number: 4,854,492

[45] Date of Patent: Aug. 8, 1989

[54] FLYWHEEL FOR AN ELECTROMECHANICAL FASTENER DRIVING TOOL

[75] Inventors: Robert B. Houck; Arnold L. McGuffey, both of Cinncinati, Ohio

[73] Assignee: Sencorp, Cincinnati, Ohio

[21] Appl. No.: 257,681

[22] Filed: Oct. 14, 1988

[51] Int. Cl.[4] ..... B25C 1/06

[52] U.S. Cl. ..... 227/131; 227/156; 173/53

[58] Field of Search ..... 227/131, 156; 173/53

[56] References Cited

U.S. PATENT DOCUMENTS 4,519,535 5/1985 Crutcher ..... 227/131

*Primary Examiner*—Frank T. Yost
*Assistant Examiner*—James L. Wolfe
*Attorney, Agent, or Firm*—Frost & Jacobs

[57] ABSTRACT

An improved flywheel for an electromechanical tool such as a nailer or stapler. The tool is provided with a blade-like driver which is frictionally moved through a working stroke by an electrically driven flywheel, the driver being squeezed between the flywheel and a support element such as a counterrotating flywheel, a low inertia roller, or the like. The flywheel has a peripheral working surface with parallel edges. The working surface of the flywheel makes a line contact with the driver during the driving stroke. The flywheel is provided with at least one groove formed in and extending along its working surface. Throughout its length the groove is angularly related to the parallel edges of the flywheel working surface so that the groove traverses the line contact between the driver and the flywheel during each working stroke. This more efficiently prevents build-up of foreign material on the driver and flywheel and produces less and more uniform wear of the driver and flywheel. When two flywheels are used, the second flywheel may be provided with a similar wiping groove.

26 Claims, 2 Drawing Sheets

21
22
23
24
25
26
27
28
29
30
31
32
33
34
35
36

FLYWHEEL FOR AN ELECTROMECHANICAL FASTENER DRIVING TOOL

TECHNICAL FIELD

The invention relates to an improved flywheel for an electromechanical fastener driving tool, and more particularly to such a flywheel provided with one or more grooves in the peripheral working face of the flywheel, which grooves extend both circumferentially of the work face and from side-to-side of the work face, to prevent the build-up of foreign material on the driver-flywheel contact area sufficient to cause loss of friction therebetween.

BACKGROUND ART

Powered nailers and staplers are well-known in the art and have come into wide-spread use. This is true because they can drive fasteners more rapidly and more precisely than can be accomplished manually, In their most common form, such powered nailers and staplers are actuated by compressed air, necessitating the presence of an air compressor and long lengths of hose.

More recently, there has been interest in electrically powered nailers and staplers, requiring only a source of electrical energy at the use site. Electrical energy is always present at a construction site. Such tools are also appropriate for the home market where electrical energy is readily available.

Prior art workers have devised many types of electromechanical fastener driving tools. For example, U.S. Pat. Nos. 4,042,036; 4,204,622; and 4,323,127 each teaches an electric impact tool wherein the driver is frictionally moved through a working stroke by means of two counterrotating flywheels, each flywheel being provided with its own electric motor. U.S. Pat. No. 4,121,745 also teaches an electric impact tool utilizing counterrotating flywheels to frictionally move the driver through its working stroke. In this reference, however, one flywheel is directly driven by an electric motor, while the other flywheel is driven by the same electric motor by means of pulleys and an elastomeric belt, gear means, or the like.

U.S. Pat. Nos. 4,189,080 and 4,298,072 teach electromechanical fastener driving tools wherein the driver is moved through a working stroke by means of a single rotating high-speed flywheel. The driver is engaged between the single flywheel and a support element. The preferred form of support element comprises a low inertia roller. Other support means, such as a linear bearing or a Teflon block, could be used to accomplish the same purpose, as is taught in these references.

Electromechanical tools of the general class just described can be used to drive nails, staples or other fastening means. For purposes of an exemplary showing, the present invention will be described in terms of its application to an electromechanical nailer. It will be understood by one skilled in the art, however, that the teachings of the present invention are equally applicable to electromechanical staple driving tools.

All electromechanical fastener driving tools of the type to which the present invention is directed share a common problem. This problem is one of build-up of foreign material on the driver and transfer of the foreign material from the driver to the flywheel or flywheels. Ultimately, a good drive is no longer possible because friction between the driver and the one or more flywheels is lost.

For example, it is common practice to arrange nails in the tool magazine in parallel spaced relationship and to maintain them in this relationship through the use of strips of tape coated with a thermal plastic hotmelt glue. It is also common practice to coat at least the initial driven portion of each nail shank with a resin based coating, or the like, to assist the nail's penetration of the workpiece and to increase the nail's holding power, once driven.

Since the driver is moving through its working stroke by means of frictional engagement with at least one flywheel, the driver will tend to get hot during use of the tool. In fact, the driver gets hot enough to melt the hotmelt glue or the coating on the nail, or both. As the driver moves between the flywheels (or the flywheel and a back-up means) under a squeeze force, the melted material builds up in front of the driver-flywheel contact area until a planing or floating action occurs, and the driver-flywheel contact is actually reduced enough to lose friction and thus the driving force.

A driver for a tool of the type contemplated by the present invention generally comprises an elongated blade-like element having parallel, planar, relatively wide forward and rearward working faces with narrow edges. The driver may be provided with a lead-in taper or ramp at the beginning of one or both working surfaces. The working faces are engaged by the counterrotating flywheels, or by one flywheel and the back-up means. When the working faces of the blade-like driver are engaged by the flywheels, or one flywheel and a back-up element, the downward force ($F_D$) applied to the driver can be stated as follows:

$$F_D = XN\,(\mu\cos^2\theta - \mathrm{SIN}\theta\mathrm{COS}\theta)$$

Where N is the squeezing force applied to the working faces of the driver, $\mu$ is the coefficient of friction, X is the number of flywheels (1 or 2), and $\theta$ is the angle of the lead-in taper or ramp on the driver.

It will be apparent from the above equation that, for a perpendicular force N, as the value of $\mu$ decreases, the value of N must increase in order to maintain the same downward force ($F_D$). It will further be understood that the squeezing force N can only be applied within reasonable limits before distortion of the driver and other problems result. As a consequence, when the loss of friction is sufficient that the driving force is reduced below an acceptable limit, it is generally necessary to disassemble the tool and clean the driver and the flywheels, or the flywheel and the back-up means. This, in turn, results in downtime of the tool. The build-up of foreign material can also result in increased wear of the working faces of the driver and the working surfaces of the flywheels or the flywheel and back-up means.

U.S. Pat. No. 4,519,535 specifically addresses this problem. For this reason, its teachings are herein incorporated by reference. Briefly, this reference teaches that if the flywheel is provided with circumferential grooves (or both flywheels are provided with circumferential grooves, when two flywheels are used), a build-up of foreign materials resulting in loss of friction between the one or more flywheels and the driver will be minimized. The grooves are parallel to the parallel edges of the working surface of the flywheel. The grooves are provided in such a way that the optimum total contact area between the one or more flywheels and the driver is maintained. The grooves constitute voids along the driver-flywheel contact line into which the foreign material tends to flow. As a consequence, a positive frictional engagement of the driver by the one or more flywheels is achieved cycle-after-cycle, for a greatly extended period of time. Furthermore, the working life of the one or more flywheels, and particularly the working life of the driver, are greatly increased, due to minimization of wear of these elements.

The present invention constitutes an improvement upon the teachings of the above-mentioned U.S. Pat. No. 4,519,535. While excellent results are achieved following the teachings of this patent, it has been found that even better results can be achieved if the one or more grooves formed in the peripheral working surface of the flywheel (or the working surfaces of the flywheels) extends not only in a circumferential direction, but also at the same time in a transverse direction across the peripheral surface of the flywheel (or flywheels). In other words, the grooves taught in accordance with the present invention are angularly related to the parallel edges of the flywheel working surface in which they are formed, as will be apparent hereinafter.

It has been found that the helical or substantially helical grooves of the present invention provide a squeeze and wipe action which tends to keep the working faces of the driver and the working surface of each of the one or two flywheels cleaner for a longer period of time.

After a very large number of cycles, it has been found that the circumferential grooves, parallel to the edges of the peripheral working surface of the flywheel (as taught in U.S. Pat. No. 4,519,535), tend to wear the adjacent working face of the driver in such a way that longitudinal ridges are produced on the driver at the positions of the flywheel grooves. These ridges represent areas of the driver working face which have not worn at least as much as the remainder of the working face. Therefore, these ridges represent areas of the driver working face which have not contributed to the overall longevity of the driver. In fact, they constitute areas from which no benefit is derived. The grooves of the present invention, on the other hand, create a more uniform wear of the adjacent driver working face, thus producing longer driver work life.

DISCLOSURE OF THE INVENTION

According to the invention, there is provided an improved flywheel for an electromechanical tool, such as a mailer or stapler. The tool is of the type having a driver which is frictionally moved through a working stroke by means of an electrically driven flywheel. The driver is squeezed between the flywheel and a support element (i.e., a counterrotating flywheel, a low inertia roller, a Teflon block, or the like). In accordance with the present invention, the flywheel is provided with one or more grooves on its peripheral working surface while maintaining the optimum contact between the flywheel and the driver. The grooves in the flywheel are angularly related to the parallel edges of the flywheel working surface in which they are formed, with the result that they extend both in the circumferential direction and in a transverse direction with respect to the working peripheral surface of the flywheel. When two driven flywheels are present in the tool, both will be provided with the grooves of the present invention, running in opposite directions.

The grooves of the present invention not only provide voids along the traveling driver-flywheel contact line or lines into which foreign material on the driver and flywheel flows, but also provide a squeeze and wipe action to more thoroughly clean the working faces of these elements. Furthermore, the working faces of these elements, particularly the driver, wear more evenly and uniformly, and therefore provide the driver with a longer working life.

DETAILED DESCRIPTION OF THE INVENTION

It will be understood that the teachings of the present invention are applicable to any electromechanical fastener driving tool of the type wherein the tool driver is moved through a work stroke by frictional engagement thereof with at least one rotating high-speed flywheel.

Figure 1:
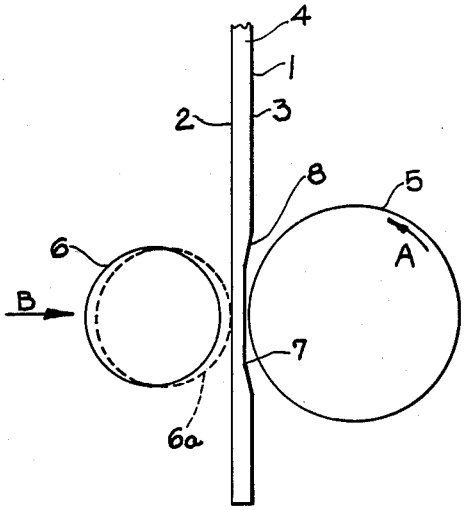
FIG. 1 (PRIOR ART)
FIG. 1 is a fragmentary, diagrammatic representation of a driver, a flywheel and a back-up member in the form of a low inertia roller, as is known in the art.

Turning first to FIG. 1, this figure illustrates a driver, a rotatably driven flywheel and a back-up means in the form of a low inertia roller. This is the general arrangement of electromechanical fastener driving tools of the type taught in the above-mentioned U.S. Pat. Nos. 4,189,080 and 4,298,072.

The driver 1 comprises an elongated blade-like element having a forward working face 2, a rearward working face 3, and thin longitudinal edges, one of which is shown at 4.

A flywheel is indicated at 5. The flywheel is rotatable in the direction of arrow A by an electric motor (not shown). FIG. 1 also illustrates a backup member in the form of a low inertia roller 6. The driver 1 is illustrated in its normal, unactuated, retracted position. It will be noted that the flywheel 5 and the low inertia roller 6 are spaced from each other by a distance greater than the thickness of driver 1. One or both of the flywheel 5 and roller 6 are shiftable toward each other to an actuated position wherein the distance between the two of them is less than the nominal thickness of the driver. For purposes of an exemplary showing, the low inertia roller 6 is illustrated as being shiftable in the direction of arrow B to its actuated position shown in broken lines at **6*a*. This shifting of roller 6** can be accomplished in any appropriate way, as for example through the use of linkages operatively attached to a workpiece contacting safety (not shown), as is well known in the art.

It will be noted that when driver 1 is in its normal, retracted position, as shown in FIG. 1, it is not actuated by the flywheel 5 and the low inertia roller 6, even when the roller is shifted to its actuated position **6*a*. This is true because the driver 1 is provided with a notch 7 reducing the nominal thickness of driver 1. The notch 7 is connected to that portion of the driver of normal thickness by a lead-in taper or ramp 8**.

In the operation of the prior art tool of the general type shown in FIG. 1, the flywheel 5 at first caused to rotate in the direction of arrow A by energization of its driving motor (not shown). This is accomplished through an electrical switch actuated by a manual trigger (not shown). When the nose (not shown) of the tool is located on the workpiece into which the nail is to be driven, the workpiece contacting safety will shift low inertia roller 6 to its position 6*a* and at the same time will close a switch (not shown) to cause energization of a solenoid (not shown) which will shift driver 1 downwardly into the bite of flywheel 5 and roller 6.

When the roller 6 is in its position 6*a*, the distance between the roller and the flywheel 5 is less than the nominal thickness of driver 1, as indicated above. In order that the ramp 8 and that portion of the driver thereabove can pass between and be engaged by roller 6 and flywheel 5, one of the roller 6 and flywheel 5 is so mounted as to give slightly so that the driver can be introduced therebetween and driven thereby.

Once the nail or fastener has been driven by driver 1, the tool is lifted from the workpiece and the workpiece responsive safety will enable the roller 6 to return to its normal position. The driver one is then freed from contact by flywheel 5 and roller 6. Means are provided to cause the freed driver to return to its normal, retracted position, as shown in FIG. 1.

Figure 2:
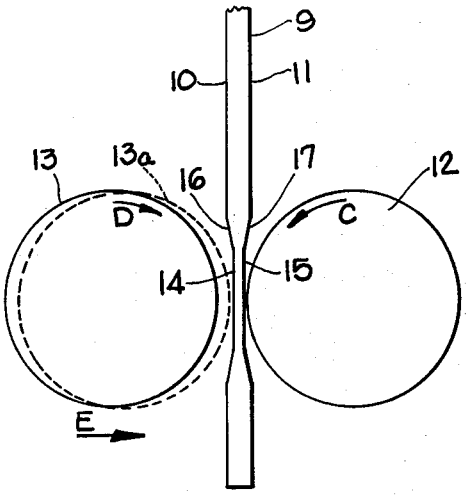
FIG. 2 (PRIOR ART)
FIG. 2 is a fragmentary diagrammatic representation of a driver and a pair of counterrotating flywheels.

FIG. 2 is a simplified, semi-diagrammatic representation of a typical prior art tool utilizing two counterrotating flywheels, as taught in the above noted U.S. Pat. Nos. 4,042,036; 4,204,622; 4,323,127; and, 4,121,745. To this end, a blade-like driver is indicated at 9 having working faces 10 and 11. The driver is located between a pair of flywheels 12 and 13. Each of flywheels 12 and 13 may be driven in the direction of arrows C and D by their own electric motors, or one of the flywheels 12 and 13 may be driven directly by an electric motor and the other may be driven indirectly by the same electric motor, as explained above.

As is shown in FIG. 2, the flywheels 12 and 13 when in their normal, unactuated condition, are spaced from each other by a distance greater than the nominal thickness of driver 9. FIG. 2 also shows driver 9 in its normal, unactuated, retracted position. One or both of the flywheels are shiftable so that they can approach each other. For purposes of an exemplary showing, flywheel 13 is illustrated as being shiftable in the direction of arrow E to an actuated position shown in broken lines at 13*a*. When flywheel 13 is in its actuated position 13*a*, the distance between it and flywheel 12 is less than the nominal thickness of driver 9. The driver 9, however, is provided with a pair of opposed notches 14 and 15 formed in its working faces 10 and 11. The notches 14 and 15 are joined to their respective working face 10 and 11 by opposed lead-in tapers or ramps 16 and 17.

The operation of the embodiment of FIG. 2 is quite similar to that described with respect to FIG. 1. First of all, by means of an appropriate switch actuated by a manual trigger (not shown) the one or two electric motors of flywheels 12 and 13 are energized, causing the flywheels to rotate in the directions of arrows C and D. Flywheel 13 is then caused to shift to its actuated position 13*a*. This can be accomplished in any appropriate way, including by means of appropriate linkage operatively connected to a workpiece contacting safety. Thereafter, driver 9 is shifted downwardly between flywheels 12 and 13 by appropriate mechanical means, solenoid means or the like. Again, one of flywheels 12 and 13 is so mounted as to give slightly to enable the ramp portion 16–17 and the working face portion 10–11 of driver 9 to enter therebetween. Once flywheels 12 and 13 engage the working faces 10 and 11 of driver 9, they cause the driver to go through its fastener driving stroke. At the end of the fastener driving stroke, the tool may be lifted from the workpiece. The workpiece contacting safety, now released, will cause flywheel 13 to shift in a direction opposite that of arrow E to its normal retracted position wherein the distance between it and flywheel 12 is greater than the nominal thickness of the driver. As a result, the driver is now free to be returned to its normal, unactuated, retracted position as shown in FIG. 2 by any appropriate means well known in the art.

It will be appreciated from FIGS. 1 and 2 that drivers 1 and 9 are driven by a frictional engagement with their respective flywheels 5, 12 and 13. As a result, drivers 1 and 9 will get hot. In fact, the drivers will get hot enough to melt the hotmelt glue of the tape or tapes (not shown) which maintain the nails in proper position within the tool magazine (not shown). Nails, so joined together, are generally referred to as "sticks" of nails. The drivers 1 and 9 also get hot enough to melt any applied coating which might be on the nails being driven thereby. These melted materials tend to stick to the driver, and then transfer to the adjacent flywheel or flywheels. It will further be appreciated from FIGS. 1 and 2 that as driver 1 and driver 9 move between roller 6 and flywheel 5 and between flywheels 12 and 13, respectively, under a squeeze force, the foreign material on the drivers in flywheels tends to build up in front of the moving driver-flywheel contact line. This build-up continues until a planing or floating action occurs, and the driver-flywheel contact is actually reduced enough to lose friction and thus driving force. When this happens, a good drive is no longer possible because the friction between the driver and its respective flywheel or flywheels has been lost. This situation can occur after a relatively small number of cycles. Heretofore, driver power could only be restored by disassembling the tool and cleaning the driver and its respective flywheel or flywheels. Furthermore, this contamination can also accelerate wear of the driver, markedly reducing its working life.

It will be understood that the contact between driver 1 and its flywheel 5 and the contact between driver 9 and its flywheels 12 and 13 are substantially line contacts. During the working stroke, these line contacts travel about the flywheels and along the drivers toward the upper ends of the drivers, thus creating contact areas between drivers 1 and 9 and their respective flywheels 5, 12 and 13. It has been found that there is an optimum contact area for a given flywheel and a given driver. This optimum contact area depends upon such factors as the size of the tool, the materials from which the driver and the flywheels are made, the load or amount of squeeze applied to the driver by the flywheel or flywheels, and the like. These factors can readily be determined by one skilled in the art, while designing a particular tool.

These factors do not constitute a limitation on the present invention. Nevertheless, it is important that, in providing flywheels 5, 12 and 13 with peripheral grooves, this optimum contact area between each flywheel and its respective driver by maintained. This can be accomplished by simply widening at least that portion of each driver contacted by flywheels 5, 12 and 13, respectively.

As indicated above, U.S. Pat. No. 4,519,535 teaches that the peripheral working surface of a flywheel can be provided with one or more circumferential grooves which are parallel to the edges of the flywheel peripheral working surface. These grooves provide voids along the driver-flywheel contact line which gives the build-up of foreign material places to flow. Since the foreign material has somewhere to go as it accumulates, it does not build up at the driver-flywheel contact area enough to cause loss of friction therebetween, for a prolonged period of time. U.S. Pat. No. 4,519,535 further teaches that the circumferential grooves do not have a tendency to fill with foreign material.

The present invention is based upon the further discovery that if the one or more grooves formed in the peripheral working surface of a flywheel are angularly related to the parallel edges of the flywheel peripheral working surface, the groove will traverse the line contact between the driver and the flywheel as this line contact travels about the flywheel and along the driver toward its upper end. As a consequence, the one or more grooves demonstrate a squeezing and wiping action of the contact area between the driver and the flywheel to more efficiently prevent build-up of foreign material therebetween and consequent loss of friction. Furthermore, both the flywheel and the driver wear more evenly and circumferential ridges are not formed in the driver, even further prolonging its working life.

Figure 3:
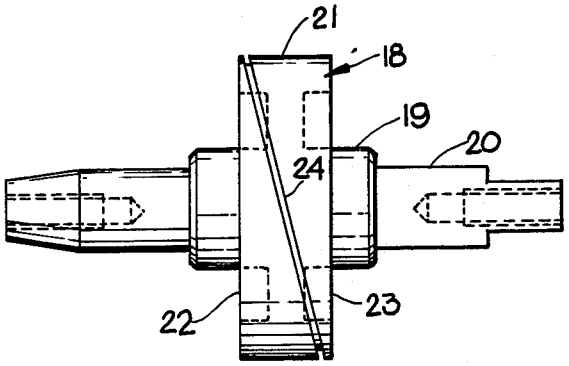
FIG. 3 is an elevational view of a flywheel according to the present invention.
Figures 4, 5, 6, 7, 8, 9, 10, 11:
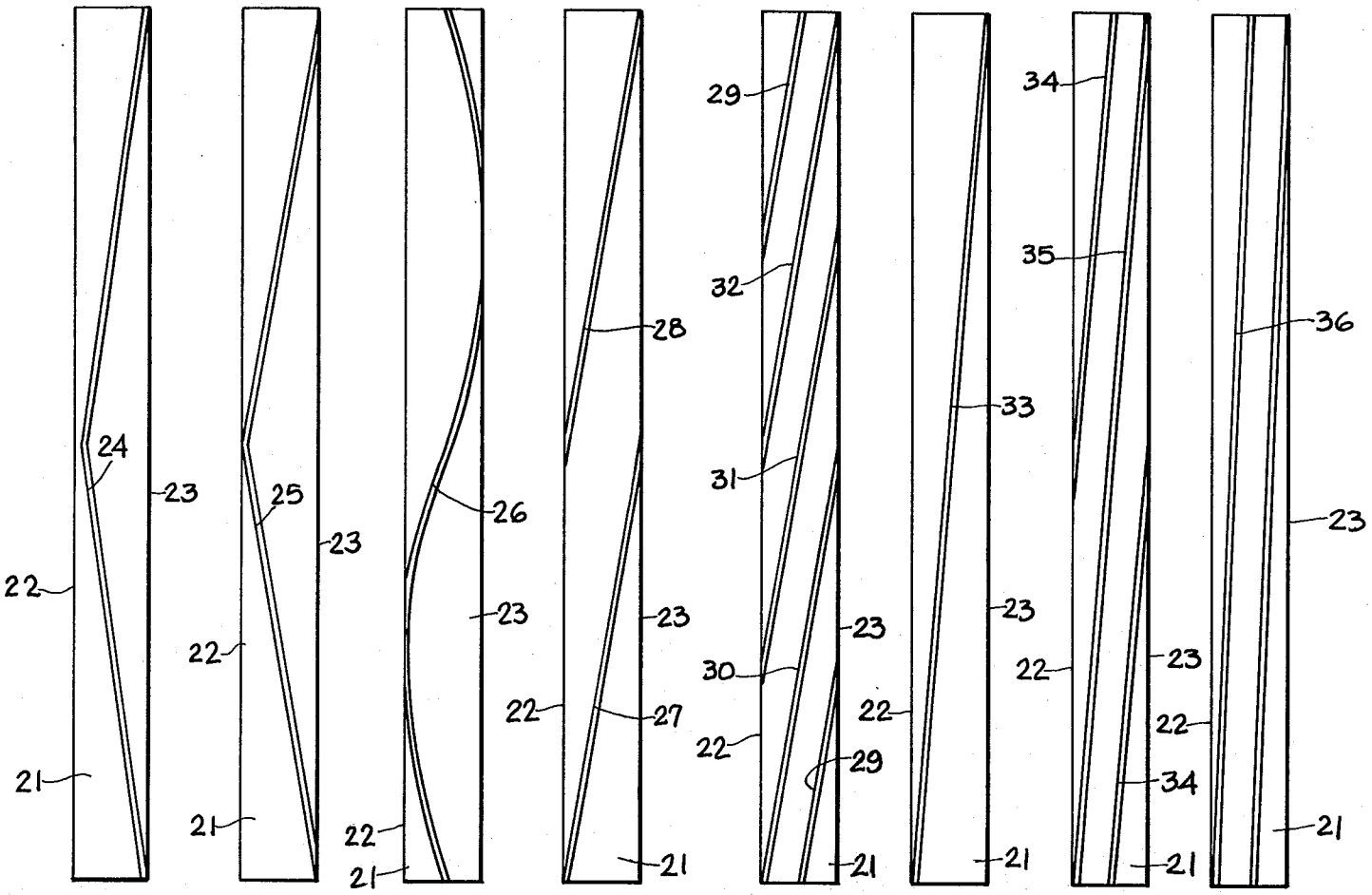
FIGS. 4–11 are diagrammatic representations of the peripheral working surface of a flywheel in flattened form, illustrating various arrangements of grooves formed thereon, in accordance with the present invention.

Reference is now made to FIGS. 3 and 4. In FIG. 3, a flywheel, generally indicated at 18, is illustrated. The flywheel 18 may be provided with appropriate hub and axial portions 19 and 20. It will be understood that these portions of flywheel 18 do not constitute a limitation of the present invention.

Flywheel 18 has a circumferential, circular working surface 21 which is transversely flat, as can be ascertained from FIG. 3. The working surface 21 has parallel side edges 22 and 23. The working surface 21 is diagrammatically represented in flat form in FIG. 4. A continuous groove 24 is formed in working surface 21 as can be best understood from FIG. 4, for one-half of the circumference of flywheel 18 the groove 24 extends from a position near working surface edge 23 to a position near working surface edge 22. For the remainder of the circumference of the flywheel, the groove 24 extends from a position near working surface edge 22 back to the position near working surface edge 23. It will be noted that the segments of groove 24 are rectilinear with respect to working surface 21 of the flywheel 18. From FIGS. 3 and 4, it will be apparent that as flywheel 18 makes a complete revolution, the groove 24 will traverse the line contact between the flywheel and the driver first in one direction, and then in the opposite direction.

In an exemplary, but non-limiting example, the flywheel of FIGS. 3 and 4 was made having a diameter of about 1.938 inches and was used with a driver having a width of about 0.5 inch. The width of the working surface of the flywheel was about 0.565 inch. The groove 24 had a width of about 0.035 inch and a depth of about 0.06 inch. The sides of groove 24 were parallel and at an angle of about 16 degrees. The flywheel was mounted in a tool, together with the driver. After a great many cycles, it was found that the frictional engagement between the flywheel and the driver was maintained without impairment. The working surface 21 of flywheel 18 and the working face of the driver showed minimal wear with no circumferential grooves being formed on the working face of the driver.

FIGS. 5 through 11 illustrate other groove arrangements which could be applied to the working surface 21 of flywheel 18. In FIG. 5, the groove 25 is substantially the same as the groove 24 of FIG. 4 with the exception that the groove extends all the way to the edge 22 and all the way to the edge 23 of working surface 21. The groove 26 of FIG. 6 is similar to the grooves 24 and 25 of FIGS. 4 and 5, but is continuously curved and has the shape of a sine wave. The groove 26 is shown going all the way to edges 22 and 23. The groove 26 could go to positions near the edges 22 and 23 in the manner of groove 24 of FIG. 4, if desired.

The remaining embodiments of FIGS. 7 through 11 provide one or more helical grooves. In the embodiment of FIG. 7, two grooves 27 and 28 are provided. The grooves are identical and extend from working surface edge 22 to working surface edge 23. Each of the grooves 27 and 28 extend about approximately one-half the length of working surface 21 (i.e., the circumference of the flywheel). The embodiment of FIG. 8 is similar to that of FIG. 7, providing for a greater number of helical grooves spaced somewhat closer together.

The embodiment of FIG. 9 employs a single groove 33 which extends from working surface edge 22 to working surface edge 23 and the full length of working surface 21. The embodiment of FIG. 10 is provided with two helical grooves 34 and 35, both of which are similar to groove 33 of FIG. 9. The groove 34 begins to a point on edge 22, spaced from the origin of groove 35 by approximately 180° or one-half the length of working surface 21.

Finally, in the embodiment of FIG. 11, the working surface is provided with a single groove 36. The groove 36 extends from edge 22 to edge 23. It will be noted that groove 36 makes two complete revolutions of the circumference of the flywheel. Unlike the embodiments of FIGS. 4, 5 and 6, the grooves of the embodiments of FIGS. 7 through 11 traverse the line contact between the flywheel and the driver in one direction only.

It will be understood that the embodiments of FIGS. 4 through 11 are exemplary only, and that other embodiments could be provided, within the scope of the present invention. The important feature is that the groove traverses along the line of contact between the flywheel and the driver during each cycle of the fastener driving tool.

When an electromechanical fastener driving tool is provided with two driven flywheels, it is preferred that both flywheels be provided with grooves of the type described above. It is further preferred that the grooves of the two flywheels be so arranged as to simultaneously wipe the driver in opposite directions. When a single flywheel is used in conjunction with a support element, such as a low inertia roller, a linear bearing, or a Teflon block, it is not necessary to provide the support element with grooves.

Modifications may be made in the invention without departing from the spirit of it. For example, the grooves of the present invention may be formed with any appropriate cross-sectional configuration.

What is claimed is:

1. In an electromechanical fastener driving tool having a thin blade-like driver with first and second faces, an electrically driven flywheel with a peripheral working surface having two parallel side edges, said working surface of said flywheel being adjacent said first face of said driver, a support element adjacent said second face of said driver and means to cause engagement of said second driver face by said support means and to cause engagement of said first driver face by said flywheel working surface with a line contact therebetween to move said driver through a working stroke, the improvement comprising at least one groove formed in and extending along said working surface of said flywheel, said at least one groove being angularly related to said parallel flywheel working surface edges throughout its length, whereby said groove traverses said line contact between said first driver face and said flywheel working surface during said working stroke.

2. The tool claimed in claim 1 wherein said groove is a single groove continuous about the periphery of said flywheel and extends from a point near one side of said flywheel working surface to a point near the other side of said flywheel working surface in one-half the periphery of said flywheel and from said last mentioned point to said first mentioned point in the remainder of the periphery of said flywheel.

3. The tool claimed in claim 1 wherein said groove is a single groove continuous about the periphery of said flywheel and extends from one side to the other side of said flywheel working surface in one half the periphery of said flywheel and from said last mentioned side to said first mentioned side of said flywheel working surface in the remainder of said periphery of said flywheel.

4. The tool claimed in claim 1 wherein said groove is a single continuous helical groove extending from a first point on one side of said flywheel working surface to a second point on the other side of said flywheel working surface in a single convolution, said first and second points being opposite each other transversely of said flywheel working surfaces.

5. The tool claimed in claim 1 wherein said groove is a single continuous helical groove extending from a first point on one side of said flywheel working surface to a second point on the other side of flywheel working surface in two parallel convolutions said first and second points being opposite each other transversely of said flywheel working surface.

6. The tool claimed in claim 1 including two continuous parallel helical grooves, each having a starting point on the same edge of said flywheel working surface 180° apart from each other and a termination point on the opposite edge of said flywheel working surface transversely opposite its respective starting point.

7. The tool claimed in claim 1 including at least two parallel helical grooves extending from one edge of said flywheel working surface to the other edge thereof.

8. The tool claimed in claim 1 wherein said support element is chosen from the class consisting of a low inertia roller, a linear bearing, and a Teflon block.

9. The tool claimed in claim 1 wherein said support element comprises a second, counterrotating flywheel, said second flywheel having a peripheral working surface with two parallel side edges, said working surface of said second flywheel being adjacent said second face of said driver, said means for causing engagement of said second driver face by said second flywheel creating a line contact therebetween during said driver working stroke, at least one groove formed in and extending along said working surface of said second flywheel, said at least one groove being angularly related to said parallel edges of said working surface of said second flywheel, whereby said groove in said working surface of said second flywheel traverses said line contact between said second flywheel working surface and said second driver face during said working stroke.

10. The tool claimed in claim 2 wherein said groove between said points is rectilinear with respect to said flywheel working surface.

11. The tool claimed in claim 2 wherein said groove between said points is continuously curved with respect to said flywheel working surface, having the shape of a sine wave.

12. The tool claimed in claim 3 wherein said groove between said sides of said flywheel working surface is rectilinear with respect thereto.

13. The tool claimed in claim 3 wherein said groove between said sides of said flywheel working surface is continuously curved with respect thereto, having a sinusoidal shape.

14. The tool claimed in claim 9 wherein said groove in said working surface of said second flywheel is so oriented as to traverse its respective line contact in a direction opposite the traverse of its respective line contact by said groove of said flywheel contacting the first face of said driver.

15. The tool claimed in claim 9 wherein said groove is a single groove continuous about the periphery of said second flywheel and extends from a point near one side of said second flywheel working surface to a point near the other side of said second flywheel working surface in one-half the periphery of said second flywheel and from said last mentioned point to said first mentioned point in the remainder of the periphery of said second flywheel.

16. The tool claimed in claim 9 wherein said groove is a single groove continuous about the periphery of said second flywheel and extends from one side to the other side of said second flywheel working surface in one half the periphery of said second flywheel and from said last mentioned side to said first mentioned side of said second flywheel working surface in the remainder of said periphery of said second flywheel.

17. The tool claimed in claim 9 wherein said groove is a single continuous helical groove extending from a first point on one side of said second flywheel working surface to a second point on the other side of said second flywheel working surface in a single convolution, said first and second points being opposite each other transversely of said second flywheel working surface.

18. The tool claimed in claim 9 wherein said groove is a single continuous helical groove extending from a first point on one side of said second flywheel working surface to a second point on the other side of second flywheel working surface in two parallel convolutions, said first and second points being opposite each other transversely of said second flywheel working surface.

19. The tool claimed in claim 9 including two continuous parallel helical grooves, each having a starting point on the same edge of said second flywheel working surface 180° apart from each other and a termination point on the opposite edge of said second flywheel working surface transversely opposite its respective starting point.

20. The tool claimed in claim 9 including at least two parallel helical grooves extending from one edge of said second flywheel working surface to the other edge thereof.

21. The tool claimed in claim 15 wherein said groove between said points is rectilinear with respect to said second flywheel working surface.

22. The tool claimed in claim 15 wherein said groove between said points being continuously curved with respect to said second flywheel working surface, having a sinusoidal shape.

23. The tool claimed in claim 16 wherein said groove between said sides of said second flywheel working surface is rectilinear with respect thereto.

24. The tool claimed in claim 16 wherein said groove between said sides of said second flywheel working surface is continuously curved with respect thereto, having a sinusoidal shape.

25. In an electromechanical fastener driving tool having a thin blade-like driver with first and second faces, an electrically driven flywheel with a peripheral working surface, said working surface of said flywheel being adjacent said first face of said driver, a support element said second face of said driver and means to cause engagement of said second driver face by said support means and to cause engagement of said first driver face by said flywheel working surface with a line contact therebetween to move said driver through a working stroke, the improvement comprising at least one groove formed in and extending along said working surface of said flywheel, said at least one groove traversing said line contact between said first driver face and said flywheel working surface to transversely wipe said first driver face during said working stroke.

26. In an electromechanical fastener driving tool having a thin blade-like driver with first and second faces, first and second electrically driven flywheels each with a peripheral working surface, said working surface of said first flywheel being adjacent said first face of said driver, said working surface of said second flywheel being adjacent said second face of said driver and means to cause engagement of said second driver face by said working surface of said second flywheel and to cause engagement of said first driver face by said working surface of said first flywheel with line contacts therebetween to move said driver through a working stroke, the improvement comprising at least one groove formed in and extending along said working surface of each of said first and second flywheels, said at least one groove of each of said first and second flywheels traversing said line contacts between said first and second flywheel working surfaces and their respective first and second driver faces to transversely wipe said first and second driver faces in opposite directions during said working stroke.

* * * * *

UNITED STATES PATENT AND TRADEMARK OFFICE

CERTIFICATE OF CORRECTION

PATENT NO. : 4,854,492

DATED : August 8, 1989

INVENTOR(S) : Robert B. Houck, et al

It is certified that error appears in the above-identified patent and that said Letters Patent is hereby corrected as shown below:

In Claim 25:

Col. 11, Line 17: Change "element said" to --element adjacent said--.

Signed and Sealed this

Twelfth Day of February, 1991

*Attest:*

HARRY F. MANBECK, JR.

*Attesting Officer*

*Commissioner of Patents and Trademarks*